US007213408B2

(12) United States Patent
Zhao

(10) Patent No.: US 7,213,408 B2
(45) Date of Patent: May 8, 2007

(54) MULTIFUNCTIONAL CONSTANT TEMPERATURE REFRIGERATOR WITH THERMAL CARRIERS

(76) Inventor: Ziquan Zhao, Room 202, Unit 1, Building 139, No. 81 XianLie Zhong Road, Guangzhou City, Guangdong Province (CN) 510070

( * ) Notice: Subject to any disclaimer, the term of this patent is extended or adjusted under 35 U.S.C. 154(b) by 235 days.

(21) Appl. No.: 10/527,593

(22) PCT Filed: Aug. 21, 2003

(86) PCT No.: PCT/CN03/00706

§ 371 (c)(1),
(2), (4) Date: Mar. 10, 2005

(87) PCT Pub. No.: WO2004/025198

PCT Pub. Date: Mar. 25, 2004

(65) Prior Publication Data

US 2006/0000231 A1 Jan. 5, 2006

(30) Foreign Application Priority Data

Sep. 11, 2002 (CN) ..... 02 1 34701

(51) Int. Cl.
*F25D 17/04* (2006.01)

(52) U.S. Cl. ..... 62/408; 62/419

(58) Field of Classification Search ..... 62/408, 62/419, 441

See application file for complete search history.

(56) References Cited

U.S. PATENT DOCUMENTS 4,563,881 A 1/1986 Bucher
5,277,035 A 1/1994 Fristoe et al.
5,778,694 A * 7/1998 Jeong ..... 62/187
5,966,951 A * 10/1999 Hallin et al. ..... 62/141
6,148,634 A 11/2000 Sherwood
6,568,773 B1 * 5/2003 Park ..... 312/406.1

FOREIGN PATENT DOCUMENTS

WO WO 02/31418 A1 4/2002

* cited by examiner

*Primary Examiner*—Melvin Jones
(74) *Attorney, Agent, or Firm*—David A. Farah; Sheldon Mak Rose & Anderson PC

(57) ABSTRACT

The present invention discloses a multifunctional constant temperature refrigerator comprising a compressor (1), an evaporator (16), a condenser (23), a cabinet (37), and freezing compartments (9), wherein the refrigerator further includes a closed cold air flow duct (15) and a negative thermal carrier assembly. The freezing compartments (9) are disposed in the cabinet (37). The closed cold air flow duct (15) is located at a back portion of the cabinet (37). The evaporator (16) is placed in the closed cold air flow duct (15). The negative thermal carrier assembly comprises a negative thermal carrier case (10) filled with negative thermal carriers and a heat pipe (12). The negative thermal carrier case (10) is disposed in each of the freezing compartments (9). A vaporization zone of the heat pipe (12) is extended into the negative thermal carrier case (10), and a condensation zone of the heat pipe (12) is extended into the closed cold air flow duct (15).

20 Claims, 5 Drawing Sheets

MULTIFUNCTIONAL CONSTANT TEMPERATURE REFRIGERATOR WITH THERMAL CARRIERS

CROSS-REFERENCE TO RELATED APPLICATIONS

The present application is a national phase application of International Patent Application No. PCT/CN2003/000706, titled "Multifunctional Constant Temperature Refrigerator With Thermal Carriers," filed Aug. 21, 2003, which claims the benefit of Chinese Patent Application No. 0213470180, titled "Multifunctional Constant Temperature Refrigerator With Thermal Carriers," filed Sep. 11, 2002, the contents of which are incorporated in this disclosure by reference in their entirety.

BACKGROUND OF THE INVENTION

1. Field of the Invention

The present invention relates to a multifunctional constant temperature refrigerator, and more particularly to a multifunctional constant temperature refrigerator with thermal carriers, in which heat is exchanged indirectly between an evaporator and the preserved stuff. The refrigerator of the invention can provide a freely and stably controllable temperature for the preserved stuff.

2. Description of the Prior Art

In order to preserve fruit and vegetables, they should be kept at a relatively low, constant temperature. Preserving fruit and vegetables minimizes their breathing intensity, blocks their metabolism, reduces as much as possible nutrient loss, slows the aging process, and permits their natural antibacterial, anti-disease and anti-decay capabilities to preserve their natural nutrition, freshness and flavor for a long period. Due to the biochemistry of plants' cells, these goals can only be attained by keeping the fruit and vegetables at a relatively low, constant temperature. Generally, in the course of naturally or artificially balancing biochemical heat, in addition to keeping fruit and vegetables to be preserved at an optimum temperature, the temperature variation should be minimized (i.e. within 0.5° C., and preferably within 0.1° C.) so as to limit the temperature variation of fruit and vegetables to about 0.1° C. Some lotus seeds that have been buried underground for over a thousand years can still bourgeon, grow and procreate, which is a vivid embodiment of the aforementioned principle (*Principles of Seeds*, P. 311–312, Science Press). To the contrary, if the environmental temperature is much lower than the appropriate temperature for the storage of fruit and vegetables, or if in the heating balance, fruit and vegetables encounter a lot of momentary changes at an extremely-low temperature to which ordinary temperature-measuring devices fail to measure, it is possible for fruit and vegetables to get frozen and damaged or physically disordered. As a result, the fruit and vegetables will speed up the decay when exposed to a normal temperature again. As is measured, the proper preservation temperature for fresh bananas is at 11° C. If a temperature to preserve bananas is lower than 10° C., or if bananas encounter repeatedly a momentary ultra-low-temperature, the bananas biological vitality will be destroyed, and then they turn black or harden, and finally have to be discarded. On the other hand, this also proves that the temperature control for preserving fruit and vegetables must conform to the biochemistry of plants' cells.

Some fruits, such as lichee, can regain their biological vitality after getting frozen once or twice. For preserving such fruits, the process requires two steps: first exterminating all attached harmful microorganisms at around −15° C. running on-end for several hours, and then keeping an appropriate constant temperature above 0° C. In fact, such requirements cannot be met at one compartment in a conventional refrigerator which uses an evaporator for directly heat-exchanging.

The preservation of meat is realized in a refrigerator through freezing to kill microorganisms that cause meat rotten from propagating. However, it is better for users to adjust the temperature within a certain range below 0° C. For example, if fresh meat is frozen at an environmental temperature of −7° C., it not only can keep a fairly long preservation period, but also is easy to be sliced for cooking in no need of further treatment. Today, even for technologically advanced refrigerators, it is the manufacturer who fixes freezing or cooling temperatures for respective compartments, and users cannot freely adjust, change or readjust the temperature set forth. Thus, it is inflexible and inconvenient in operation.

Since the first family refrigerator in the world was produced almost a hundred years ago, Either in the previously used serial recycling system or in the recently "separately recycling" technology that was first reported in Science Daily on Mar. 15, 2002, it is the evaporator that directly supplies a cooling source for the stuff to be preserved (equivalent through separate metal plates). As is well known, the evaporator of a refrigerator provides a cooling source below −20° C., which keeps most fruit and vegetables at a suitable preservation temperature for is above 0° C. Heat between the stuff and the refrigerator (absorbing biochemical heat of the stuff) is exchanged directly via air. Thus no matter what temperature-controlling technology is employed, momentary shocks of temperature variation cannot be controlled within 1° C. or 2° C. Thus, fruit and vegetables obviously cannot avoid the decay if they are preserved in the above-described refrigerator for a long period. The first thing for preserving fruit and vegetables is to avoid exchanging heat between great differences of the temperature, which is exactly the most prominent flaw of the present refrigerators.

Heat-exchanging between two contrasting temperatures can also make the exposed surface of fruit and vegetables lose water much faster than water transfer of the inside thereof. As a result, the surface of fruit and vegetables will crimple, which hinders normal metabolism of fruit and vegetable, and fails to achieve the result of keeping fruit and vegetables fresh in the real sense. If airtight plastic bags are used to wrap up stuff to be preserved, the vapor in the bag will shortly reach saturation, metabolic activities are forced to stop for water cannot be released, which will cause the stuff decayed.

Direct heat-exchanging between the evaporator and the frozen or cooled stuff can also cause the surface of the evaporator frosting repeatedly, which will increase heat resistance and definitely waste more power.

After all, there exists the drawback for the present refrigerators to keep fruit and vegetables fresh under the biochemical principles, which is the key to improve refrigerator technologies.

SUMMARY OF THE INVENTION

One object of the present invention is to provide a multifunctional constant temperature refrigerator with thermal carriers for indirectly exchanging heat between an evaporator and the preserved stuff.

Another object of the present invention is to provide a multifunctional constant temperature refrigerator with thermal carriers as described above, in which the temperature in each of freezing compartments can be kept constantly and set freely by users.

Still another object of the present invention is to provide a multifunctional constant temperature refrigerator with thermal carriers having function as described above and that can warm the preserved stuff using heat generated during the cooling operation.

To achieve the above objects, the present invention provides a multifunctional constant temperature refrigerator with thermal carriers including: a compressor, an evaporator, a condenser, a cabinet, and freezing compartments, which further includes a closed cold air flow duct and a negative thermal carrier assembly. The closed cold air flow duct is located at a back portion of the cabinet. The evaporator is placed within the closed cold air flow duct. The negative thermal carrier assembly comprises a negative thermal carrier case filled with negative thermal carriers and a heat pipe. The negative thermal carrier case is disposed in each of the freezing compartments. A vaporization zone of the heat pipe is extended into the negative thermal carrier case, and a condensation zone of the heat pipe is extended into the closed cold air flow duct.

The heat pipe is typically an ammonia heat pipe.

To improve the efficiency of exchanging heat, the negative thermal carrier assembly further includes a plurality of accessory heat conducting fins. An end portion of the heat conducting fins is extended into the closed cold air flow duct and another end portion of the heat conducting fins is extended into the negative thermal carrier case.

A cold air fan may be further set within the closed cold air flow duct Cold sources supplied by the evaporator are forcibly discharged to the condensation zone of the ammonia heat pipe and the accessory heat conducting fins along the closed cold air flow duct by the cold air fan during the cooling operation. The forced cold air provides the negative thermal carriers in the negative thermal carrier case of each of the freezing compartments with the desired temperature rapidly, so that the cooling efficiency of the refrigerator can be enhanced.

To ensure the temperature in each of the freezing compartments reaches a preset temperature precisely, temperature sensors are provided in the present invention. A negative thermal carrier temperature sensor is placed in the negative thermal carrier case, and a positive thermal carrier temperature sensor with the same precision as the temperature sensor is placed in each of the freezing compartments.

To utilize the natural air convection caused by a temperature difference between the preserved stuff and the negative thermal carriers, an arc-shaped air flow shroud may be mounted at a lower portion of the negative thermal carrier case of each of the freezing compartments.

To provide a more suitable environment for preserving the stuff, the cabinet may provide a plurality of compartments as required.

To keep each of the freezing compartments respectively at a temperature that is instantly set by users, the present invention may further include a dual flow passage defined by a portion of the closed cold air flow duct with respect to the freezing compartments. The dual flow passage having a rear flow passage and a front flow passage with the condensation zone of the heat pipe is separated by a passage clapboard. A passage switching device is disposed at the inlet of the dual flow passage for switching the passage of cold air.

The passage switching device comprises a roller which has a channel therein extending upwards in a direction of the diameter. A reset gravity bar is disposed at an inner surface of the roller, a hinged iron flake is disposed below the roller, and an electromagnet is mounted at the inner surface of the air flow duct which is adjacent to the inlet of the dual flow passage. The electromagnet is faced to the hinged iron flake in parallel, so as to contact the same during the operation.

The passage clapboard with a bottom end adjacent the outer wall of the passage switching device is vertically secured at the inner surface of the closed cold air flow duct.

A mobile cover that is connected to the passage clapboard is provided at the outlet of the dual flow passage, having a size to match the outlet of the front flow passage and the rear flow passage for covering or uncovering the front flow passage and the rear flow passage.

The size of the outlet of the channel the passage switching device is designed to inosculate that of the outlet of the front flow passage and the rear flow passage, while it is only half of the size of the inlet of the passage switching device. A projected positioning bar is located at the front of the periphery of the outlet of the passage switching device, and a stop block corresponding to the projected position bar is located at the inner surface of the front flow passage.

Two clapboards are symmetrically mounted within the passage switching device which extend from the inlet to the outlet of the channel to further define the channel of the passage switching device for smoothly discharging cold air.

To warm food using heat generated during the cooling operation, the cabinet may provide a warm air flow duct with two openings (each at one end thereof), one of which is faced to the compressor. The condenser is disposed in the warm air flow duct. A warming compartment, a positive thermal carrier case and a one-way heat pipe are provided in the cabinet. The positive thermal carrier case and the one-way heat pipe are disposed within the warming compartment. A condensation zone of the one-way heat pipe is extended into the positive thermal carrier case, and a vaporization zone of the one-way heat pipe is extended into the warm air flow duct.

The one-way heat pipe is typically a one-way water heat pipe.

To improve the efficiency of heat-exchanging, a warm air fan may be provided within the warm air flow duct to speed up warm air through the compressor and the condenser.

To further improve the efficiency of heat-exchanging, a plurality of fins for conducting heat may be provided for the ammonia heat pipe, the one-way water heat pipe, the evaporator and/or the condenser, respectively.

The closed cold air flow duct and the warm air flow duct, which are separated by an insulation layer, are vertically spaced at a back portion of the cabinet.

According to the present invention, a temperature corresponding to each of the compartments which is instantly set by the user is deemed as a zero point. Since each compartment has a different desired temperature, the zero point is not an accurate value but a representative one of the real temperature. Thus, the negative thermal carriers mean thermal carriers (i.e., polymers phase-change materials) having a temperature lower than the zero point, and the positive thermal carriers mean thermal carriers having a temperature higher than the zero point.

The operation of the present invention is described as follows.

By means of exchanging heat among the negative thermal carriers, the ammonia heat pipe, the accessory heat conducting fins and the evaporator, the negative thermal carriers have a relatively lower temperature than a temperature instantly set by the user, so as to absorb heat from the preserved stuff at any time. Thermal carriers are placed in a sealed negative thermal carrier case which is made of metal materials that may have an average thickness of around 3 cm. The aforementioned negative thermal carrier case comprises a planar top wall and a bottom portion having projected arc-shaped ribs. The vaporization zone of the ammonia heat pipe and the fins thereof together with one end of the accessory heat conducting fins are extended into the negative thermal carrier case. An arc-shaped air flow shroud having a rectangular opening at the center portion thereof is mounted below and adjacent the ribs of the negative thermal carrier case, so as to form a heat-exchanging cycle utilizing the natural air convection caused by a temperature difference between the preserved stuff and the negative thermal carriers. The condensation zone of the ammonia heat pipe and the fins thereof together with another end of the accessory heat conducting fins are extended into the closed cold air flow duct via a rectangular hole with a sealed plastic wrap which is located at a rear wall of each compartment. As such, heat-exchanging between the negative thermal carriers and the preserved stuff and that between the negative thermal carriers and the evaporator constitute two independent systems, which can be operated at any time even without air communication. According to the present invention, a singlechip is provided to automatically control these two systems. The maximum of the momentary variation of the temperature in the process of exchanging heat or the quality of the relatively low constant temperature is determined by a temperature difference between the lower limit of the negative thermal carriers and a desired temperature in each of the freezing compartments. Both the lower limit of the negative thermal carriers and the desired temperature in the freezing compartments can be instantly set or adjusted by the user according to the requirement.

Such a heat-exchanging structure provides advantages as follows:

1. Negative thermal carriers are employed to exchange heat with the preserved that avoids directly exchanging heat between the preserved stuff and cold air with a significant temperature change, which provides a more favorable environment for preserving food.

2. A temperature difference between the upper and lower temperature limits of the negative thermal carriers can be minimized to obtain a fairly constant temperature for the preserved stuff. For example, the temperature difference can be controlled within 0.1° C. for the preserved stuff, even in the metabolism itself.

3. The relative humidity can be held at about 95% by setting the lower limit of the negative thermal carriers to a relatively low value, such as 1° C. A higher humidity environment is in favor of preserving the stuff.

4. The desired temperature in each compartment can be adjusted freely at a range of from −15° C. to +20° C. as required. The preserved stuff can first be frozen quickly, and then manually or automatically controlled to increase to an appropriate temperature.

5. No frosting occurs at the surface of the evaporator in the refrigerator of the present invention. As a result, the efficiency of heat-exchanging is enhanced. Power stored in negative thermal carriers makes the frequency of on/off of the refrigerator reduced to economize energy.

6. Heat generated during the cooling operation can be absorbed by the vaporization zone of the one-way water heat pipe and heat conducting fins thereof to warm the preserved stuff. Thus the preserved stuff with a temperature about 50° C. is provided at any time, which is convenient to users and makes full use of energy.

Figure 1:
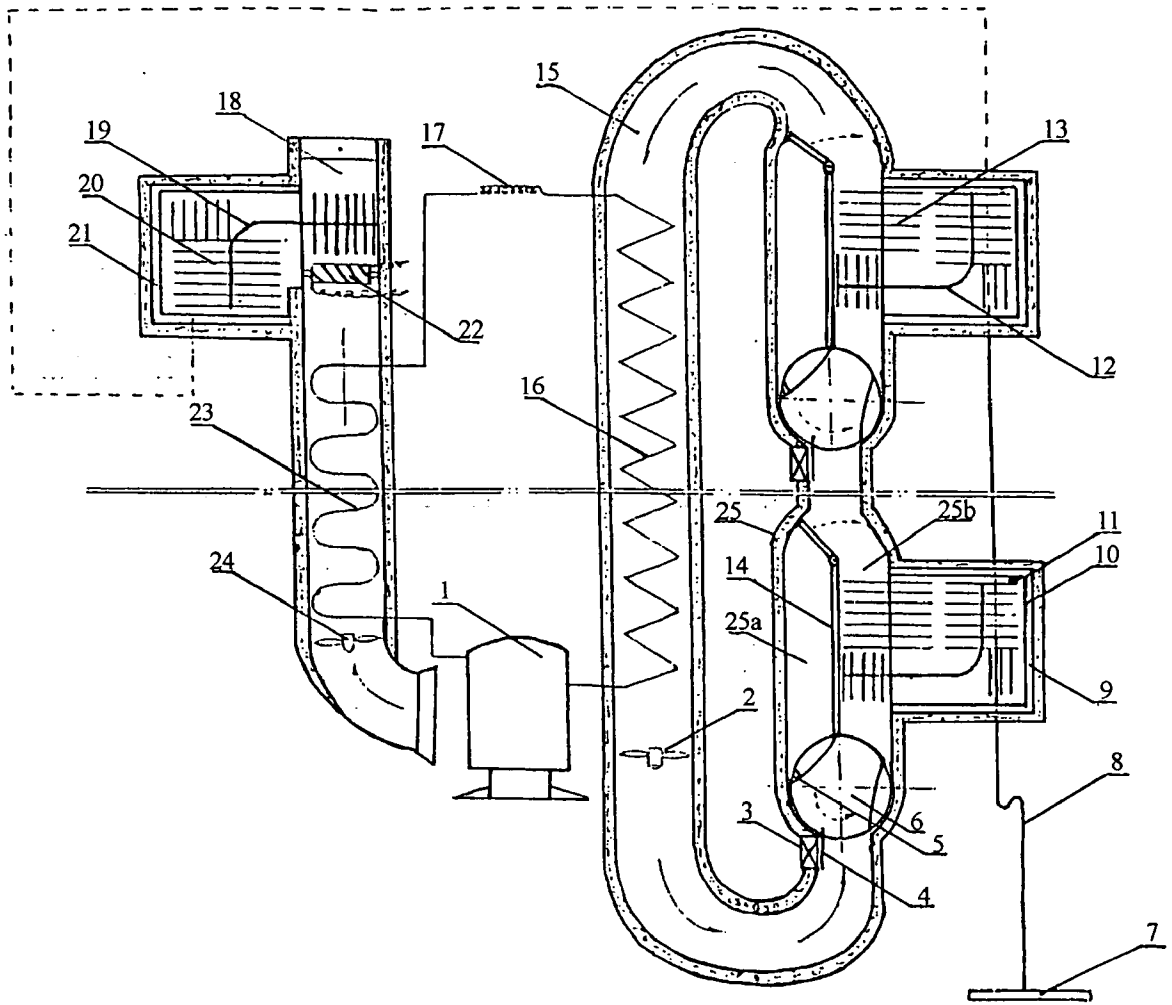
FIG. 1 is a principle diagram of a refrigerator according to the present invention.

a compressor 1, a cold air fan 2, an electromagnet 3, a hinged iron flake 4, a reset gravity bar 5, a passage switching device 6, a water-collecting container 7, a water-collecting duct 8, freezing compartments 9, a negative thermal carrier case 10, a negative thermal carrier temperature sensor 11, an ammonia heat pipe 12, accessory heat conducting fins 13, a passage clapboard 14, a closed cold air flow duct 15, an evaporator 16, a capillary tube 17, a warm air flow duct 18, a one-way heat pipe 19, a positive thermal carrier case 20, a warming compartment 21, an electric heater 22, a condenser 23, a warm air fan 24, a dual flow passage 25, a rear flow passage 25*a*, a front flow passage 25*b*, an arc-shaped air flow shroud 26, a display 27, a manual cold system switch 28, a manual warm system switch 29, a temperature setting button 30, a fast-freezing setting button 31, a positive thermal carrier temperature sensor 32, an insulation layer 33, an outlet of the warm air flow duct 34, a positioning bar 35, a stop block 36, and a cabinet 37.

DETAILED DESCRIPTION OF THE PREFERRED EMBODIMENTS

Preferred embodiments of the present invention will now be described in detail with reference to the accompanying drawings.

Figure 2:
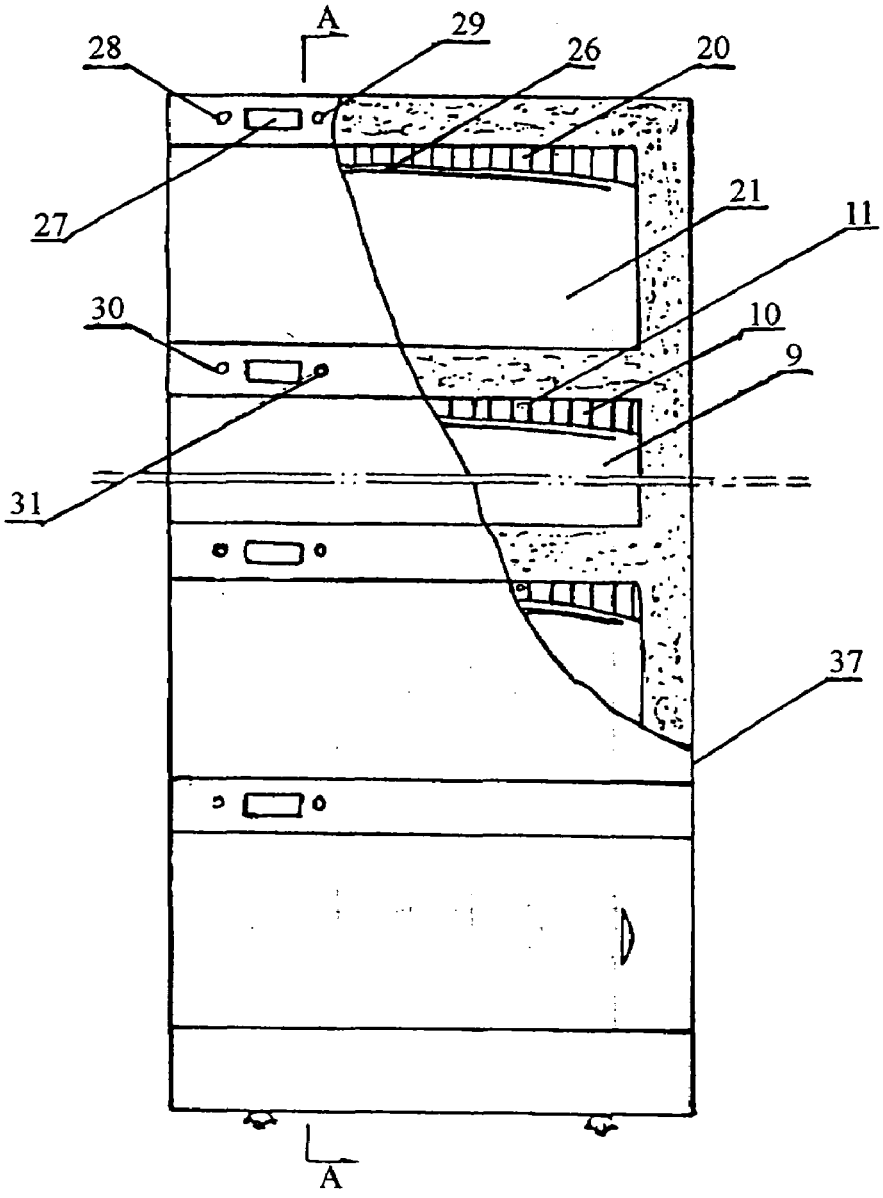
FIG. 2 is a front view of a refrigerator according to the present invention.
Figure 3:
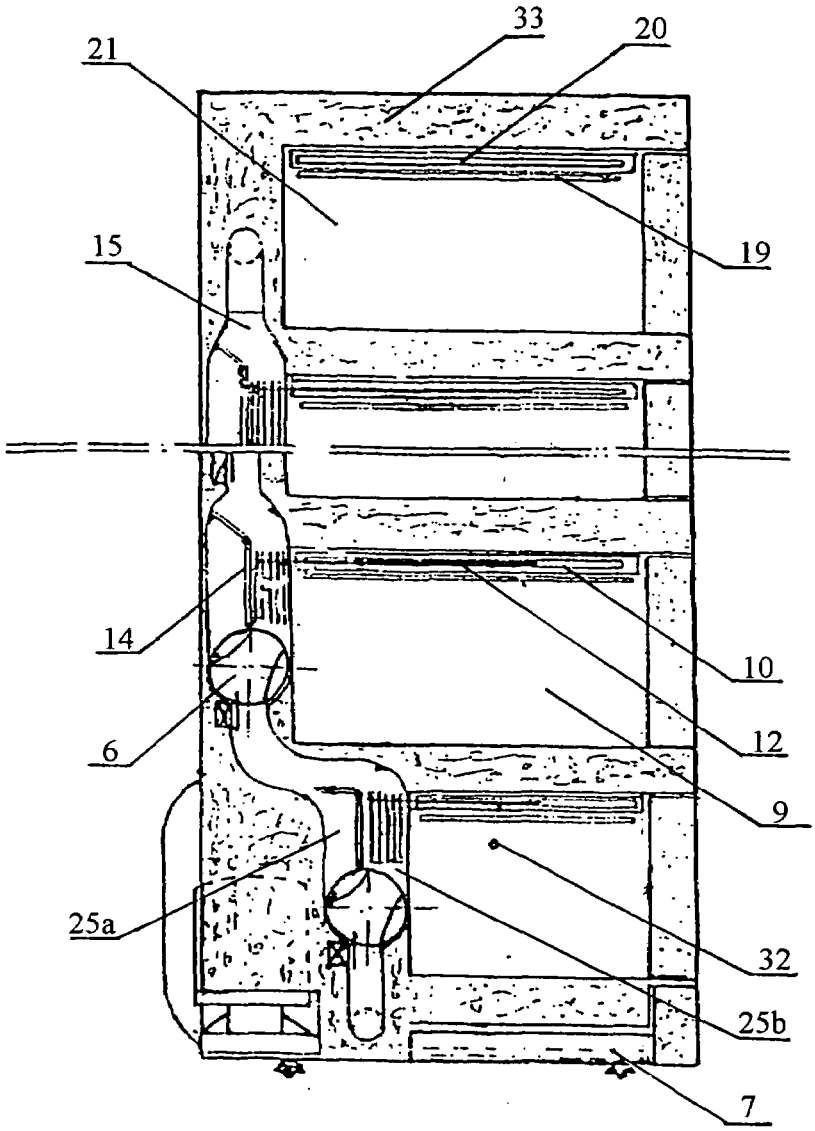
FIG. 3 is a cross-sectional view along the line A—A in FIG. 2.
Figure 4:
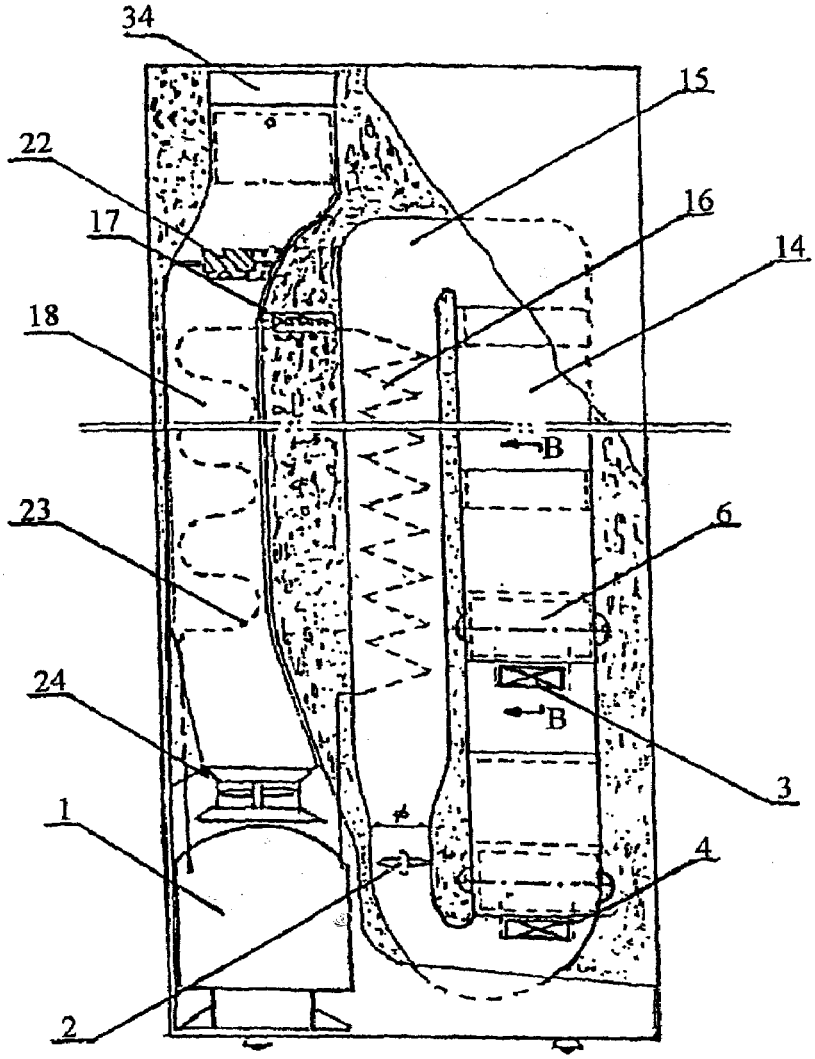
FIG. 4 is a back view of the refrigerator shown in FIG. 2.
Figure 5:
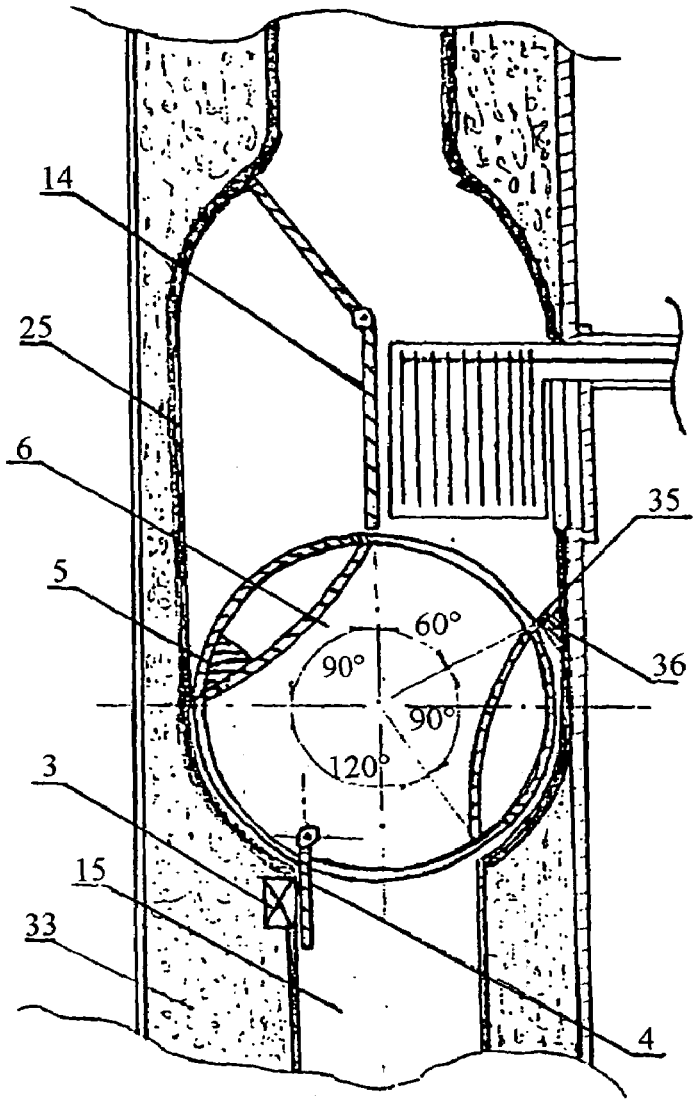
FIG. 5 is an enlarged cross-sectional view of a portion of a dual flow passage according to the present invention along the line B—B in FIG. 4.

As shown in FIGS. 1–5, a multifunctional constant temperature refrigerator with thermal carriers of the present invention includes: a compressor 1, an evaporator 16, a condenser 23, a capillary tube 17, a cabinet 37, and freezing compartments 9, a positive thermal carrier temperature sensor 32 for sensing the temperature in the corresponding compartment that is located at an inner wall of each of the freezing compartments to provide the real-time temperature to a display 27, a cold air flow duct 15, a cold air fan 2, a negative thermal carrier temperature sensor 11 mounted in a negative thermal carrier case 10 which is filled with negative thermal carriers, an ammonia heat pipe 12 with fins and accessory heat conducting fins 13. The freezing compartments 9 are located within the cabinet 37, the cold air flow duct 15 having the evaporator 16 and the cold air fan 2 disposed inside is vertically placed at a back portion of the cabinet 37, the negative thermal carrier case 10 is disposed in the freezing compartments 9, a vaporization zone of the ammonia heat pipe 12 and the accessory heat conducting fins with one end portion thereof are extended into the negative thermal carrier case 10, a condensation zone of the ammonia heat pipe 12 and the accessory heat conducting fins with another end portion thereof are extended into the closed cold air flow duct 15. When the cooling operation of the refrigerator is processed, first a desired temperature in the freezing compartments is set as an upper limit of the negative thermal carriers, and then a lower limit of the negative thermal carriers is set. During the operation thereafter, the cold air fan 2 discharges cold air generated from the evaporator 16 to the vaporization zone of the ammonia heat 12 and the fins thereof as well as one end portion of the accessory heat conducting fins 13 along the closed cold air flow duct 15, so as to exchange heat with the negative thermal carrier case 10. Thus, the negative thermal carriers in the negative thermal carrier case 10 can further exchange heat with the preserved stuff in the freezing compartments 9. When the negative thermal carriers in the negative thermal carrier case 10 reach the preset lower limit, the negative thermal carrier temperature sensor 11 transmits a stop signal to stop heat-exchanging between the negative thermal carrier case 10 and cold air, while heat-exchanging between the negative thermal carrier case 10 and the preserved stuff is going on. When the negative thermal carriers in the negative thermal carrier case 10 reach the preset upper limit, the negative thermal carrier temperature sensor 11 transmits a start signal to restart heat-exchanging between the negative thermal carrier case 10 and cold air. The aforementioned process is operated repeatedly. As such, the negative thermal carriers that are employed avoid directly exchanging heat between the preserved stuff and cold air, so as to reduce the temperature variation and provide a suitable environment for preserving the stuff.

To provide a more favorable environment for preserving the stuff, the cabinet 37 may provide a plurality of compartments in practice. To keep each of the freezing compartments 9 at a temperature which can be instantly set by users, the refrigerator according to the present invention may further comprise a dual flow passage 25 defined by a portion of the closed cold air flow duct 15 with respect to the freezing compartments 9. The dual flow passage 25 having a rear flow passage 25*a* and a front flow passage 25*b* in which the condensation zone of the ammonia heat pipe is disposed is separated by a passage clapboard 14. A passage switching device 6 having a roller-configured is disposed at the inlet of the dual flow passage 25 for switching the passage of cold air. The passage switching device 6 has a channel located in a direction of the diameter having an outlet and an inlet. The outlet of the channel of the passage switching device 6 has such a size that it matches the outlet of the front flow passage 25*b* and the rear flow passage 25*a*, respectively, while the passage has a size of the inlet twice that of the outlet. A reset gravity bar 5 is disposed at the inner surface of the roller, a hinged iron flake 4 is disposed below the roller and an electromagnet 3 is mounted at the inner surface of the cold air flow duct 15 and adjacent the inlet of the dual flow passage 25. The electromagnet 3 and the hinged iron flake 4 are disposed to face each other in parallel, so that they can be combined together after the start of the operation. A projected positioning bar 35 is located at the front of the periphery of the outlet of the channel of the passage switching device 6, and a stop block 36 corresponding to the projected positioning bar 35 is located at the inner surface of the front flow passage 25*b*. Two clapboards are symmetrically mounted within the passage switching device 6 to further define the channel extending from the inlet to the outlet of the passage switching device 6 for smoothly discharging cold air. The passage clapboard 14 with a bottom portion adjacent the outer wall of the passage switching device 6 is vertically secured at the inner surface of the closed cold air flow duct 15. A mobile cover which is sized to match the outlet of the front flow passage 25*b* and the rear flow passage 25*a* is pivotally connected to the passage clapboard 14. When the cold air fan 2 discharges cold air towards the cover through the rear flow passage 25*a*, the cover is pivotally turned to close the front flow passage 25*b*; otherwise, when the cold air fan 2 discharges cold air towards the cover through the front flow passage 25*b*, the cover is pivotally turned to close the rear flow passage 25*a*. In this way, no matter how many passage switching devices at any states are provided in the closed cold air flow duct 15, cold air can be discharged smoothly. When the temperature of the negative thermal carriers reaches the desired temperature (i.e., the upper limit of the negative thermal carriers) of the freezing compartments 9, the compressor 1 is driven to generate cold air, and the electromagnet 3 contacts the hinged iron flake 4 to control the inlet of the passage switching device 6 communicating with the condensation zone of the ammonia heat pipe 12 and the fins thereof as well as another end portion of the accessory heat conducting fins 13 for exchanging heat with the negative thermal carrier case 10. When the temperature of the negative thermal carriers sensed by the negative thermal carrier temperature sensor 11 reaches the lower limit of the negative thermal carriers, a stop signal is automatically transmitted (because the freezing compartments are arranged in parallel to each other, the compressor 1 can be stopped only when all the passage switching devices have transmitted stop signals), the electromagnet 3 releases the hinged iron flake 4, and the passage switching device 6 pivotally turns 60-degree in association with the reset gravity bar 5 to close the front flow passage 25*b* and open the rear flow passage 25*a*, until the temperature of the negative thermal carriers has again raised to the upper limit of the negative thermal carriers. The aforementioned process is operated repeatedly during this ordinary cooling operation to provide the preserved stuff at a stabler and relatively low temperature.

If the user wants to stop using one of the freezing compartments temporarily, he or she can set the lower limit of the negative thermal carriers equal to or higher than the desired temperature (the upper limit preset by the user) thereof. These two limits are reference values programmed in a singlechip by the user, thus the operation can be kept on only when the upper limit is higher than the lower limit.

Moreover, when the preserved stuff is required to be frozen quickly, the upper limit and lower limit of the negative thermal carriers can first be set at around −15° C. while keeping a constant difference between them, and then manually or automatically set the limits to an appropriate temperature.

To warm food by using heat generated during the cooling operation, the cabinet preferably provides a warm air flow duct 18 with two openings each at one end thereof, one of which is faced to the compressor 1. The warm air flow duct 18 has a rectangular cross section except a circular to match the shape of the fan at the lower potion thereof adjacent a warm air fan 24. A condenser 23 is disposed in the warm air flow duct 18. A warming compartment 21, a positive thermal carrier case 20 filled with positive thermal carriers and a one-way water heat pipe 19 are provided in the cabinet 37. The positive thermal carrier case 20 and the one-way water heat pipe 19 are disposed within the warming compartment 21. The condensation zone of the one-way water heat pipe 19 is extended into the positive thermal carrier case 20, and the vaporization zone of the one-way water heat pipe 19 is extended into the warm air flow duct 18. The closed cold air flow duct 15 and the warm air flow duct 18, which are separated by an insulation layer 33, are vertically spaced at a back portion of the cabinet. The warm air flow duct 18 supplies heat generated by the compressor 1 and the condenser 23 to the vaporization zone of the one-way water heat pipe 19 and fins thereof by air flow, and then exhausts warm air through an outlet of a warm air flow duct 34. The condensation zone of the one-way water heat pipe 19 provides heat for the warming compartment 21 through the positive thermal carrier case 20.

A water collecting duct 8 placed in the cabinet 37 receives condensed water from the freezing compartments and the closed cold air flow duct 15, which is directed into a water-collecting container 7 disposed at the bottom portion of the refrigerator. The main portion of the water collecting duct 8 may be placed in the insulation layer 33 at the back portion of the cabinet 37 to avoid the collecting duct 8 from being blocked by freezing.

According to the present invention, the number of the freezing compartments 9 is freely set, for which the capacity of the compressor may be determined by market requirements. The refrigerator according to the present invention may also be configured in a multi-drawer style or with side-by-side refrigerator compartments. It will be apparent to those skilled in the art that the compartments or the drawers are exchangeable. In order to reduce the influence caused by a temperature difference between the compartments, and to utilize the air convection, preferably the compartments are disposed in such a manner that the desired temperature in the compartments decreases from top to bottom.

According to the present invention, the compressor 1, the cold air fan 2 and the warm air fan 24 are connected in parallel to start or stop simultaneously. A manual cold system switch 28 connected to a one-hour timer is provided in the warming compartment. The manual cold system switch 28 is connected to each electromagnet in parallel, and then to the compressor 1 in serial. A manual warm system switch 29 with a timer is provided to start an electric heater 22 adjacent the vaporization zone of the one-way water heat pipe. The switches 28 and 29 are mounted on the warming compartment 21 for warming food even when the cooling operation is not required. In the invention an independent programmable singlechip control system is provided for each compartment. All functions are implemented by controlling the electromagnet 3, which determines whether or how long the current compartment operates. Certainly, a more powerful singlechip can be used to control all compartments if desired. A display can be provided to display a temperature in each freezing compartment, to manually check, set or modify the lower limit and the upper limit of the negative thermal carriers in each of the freezing compartments and other operation instructions. A temperature setting button 30 and a fast-freezing setting button 31 set at the freezing compartments are multifunctional, with a combination thereof, all the aforementioned functions can be exploited.

The invention claimed is:

1. A multifunctional constant temperature refrigerator with thermal carriers comprising:

a compressor;

an evaporator;

a condenser;

a cabinet; and freezing compartments, wherein the refrigerator further includes a closed cold air flow duct and a negative thermal carrier assembly, said closed cold air flow duct being disposed at a back portion of the cabinet, said evaporator being placed within the closed cold air flow duct, said negative thermal carrier assembly being composed of a negative thermal carrier case filled with negative thermal carriers and a heat pipe, said negative thermal carrier case being disposed in each of the freezing compartments, a vaporization zone of said heat pipe being extended into the negative thermal carrier case, and a condensation zone of said heat pipe being extended into the closed cold air flow duct.

2. The multifunctional constant temperature refrigerator with thermal carriers of claim 1, wherein said heat pipe is an ammonia heat pipe.

3. The multifunctional constant temperature refrigerator with thermal carriers of claim 2, wherein said negative thermal carrier assembly further includes: a plurality of accessory heat conducting fins, of which one end portion is extended into a closed cold air flow duct and another end portion is extended into a negative thermal carrier case.

4. The multifunctional constant temperature refrigerator with thermal carriers of claim 3, wherein a cold air fan is provided in said closed cold air flow duct to speed up cold air.

5. The multifunctional constant temperature refrigerator with thermal carriers of claim 4, wherein a negative thermal carrier temperature sensor is disposed in said negative thermal carrier case and a positive thermal carrier temperature sensor with the same precision as the temperature sensor is disposed in said freezing compartments.

6. The multifunctional constant temperature refrigerator with thermal carriers of claim 1, wherein a dual flow passage is defined by a portion of the closed cold air flow duct corresponding to the freezing compartments, said dual flow passage having a rear flow passage and a front flow passage in which a condensation zone of the ammonia heat pipe is disposed, is separated by a passage clapboard, and a passage switching device is disposed at an inlet of the dual flow passage for switching the passages.

7. The multifunctional constant temperature refrigerator with thermal carriers of claim 6, wherein said passage switching device comprises a roller which has a channel therein extending upwards in a direction of the diameter, a reset gravity bar is disposed at the inner surface of the roller, a hinged iron flake is disposed below the roller, an electromagnet is mounted at the inner surface of the air flow duct which is adjacent the inlet of the dual flow passage with respect to said hinged iron flake, and said electromagnet is placed to face said hinged iron flake in parallel.

8. The multifunctional constant temperature refrigerator with thermal carriers of claim 7, wherein the passage switching device has an inlet having a size matching the outlet of both the front flow passage and the rear flow passage of the dual flow passage, and an outlet having a size half of that of the inlet, a projected positioning bar is located at the front portion of the periphery of the outlet of the passage switching device, and a stop block corresponding to the projected positioning bar is located at the inner surface of the front flow passage.

9. The multifunctional constant temperature refrigerator with thermal carriers of claim 8, wherein two clapboards are symmetrically mounted within the passage switching device to define a channel extending from the inlet to the outlet of the passage switching device.

10. The multifunctional constant temperature refrigerator with thermal carriers of claim 6, wherein a warm air flow duct with two openings each at one end thereof is provided in the cabinet where one of the openings is faced to said compressor, a condenser is disposed within the warm air flow duct, wherein a warming compartment, a positive thermal carrier case and a one-way heat pipe are further provided in the cabinet where the positive thermal carrier case and the one-way heat pipe are disposed within the warming compartment, a condensation zone of the one-way heat pipe is extended into the positive thermal carrier case, and a vaporization zone of the one-way heat pipe is extended into the warm air flow duct.

11. The multifunctional constant temperature refrigerator with thermal carriers of claim 10, wherein said one-way heat pipe is a one-way water heat pipe.

12. The multifunctional constant temperature refrigerator with thermal carriers of claim 11, wherein a warm air fan is provided within said warm air flow duct.

13. The multifunctional constant temperature refrigerator with thermal carriers of claim 12, wherein a plurality of fins are respectively provided for the heat pipe, the single way heat pipe, the evaporator and/or the condenser.

14. The multifunctional constant temperature refrigerator with thermal carriers of claim 2, wherein a dual flow passage is defined by a portion of the closed cold air flow duct corresponding to the freezing compartments, said dual flow passage having a rear flow passage and a front flow passage in which a condensation zone of the ammonia heat pipe is disposed, is separated by a passage clapboard, and a passage switching device is disposed at an inlet of the dual flow passage for switching the passages.

15. The multifunctional constant temperature refrigerator with thermal carriers of claim 3, wherein a dual flow passage is defined by a portion of the closed cold air flow duct corresponding to the freezing compartments, said dual flow passage having a rear flow passage and a front flow passage in which a condensation zone of the ammonia heat pipe is disposed, is separated by a passage clapboard, and a passage switching device is disposed at an inlet of the dual flow passage for switching the passages.

16. The multifunctional constant temperature refrigerator with thermal carriers of claim 4, wherein a dual flow passage is defined by a portion of the closed cold air flow duct corresponding to the freezing compartments, said dual flow passage having a rear flow passage and a front flow passage in which a condensation zone of the ammonia heat pipe is disposed, is separated by a passage clapboard, and a passage switching device is disposed at an inlet of the dual flow passage for switching the passages.

17. The multifunctional constant temperature refrigerator with thermal carriers of claim 5, wherein a dual flow passage is defined by a portion of the closed cold air flow duct corresponding to the freezing compartments, said dual flow passage having a rear flow passage and a front flow passage in which a condensation zone of the ammonia heat pipe is disposed, is separated by a passage clapboard, and a passage switching device is disposed at an inlet of the dual flow passage for switching the passages.

18. The multifunctional constant temperature refrigerator with thermal carriers of claim 1, wherein said passage switching device comprises a roller which has a channel therein extending upwards in a direction of the diameter, a reset gravity bar is disposed at the inner surface of the roller, a hinged iron flake is disposed below the roller, an electromagnet is mounted at the inner surface of the air flow duct which is adjacent the inlet of the dual flow passage with respect to said hinged iron flake, and said electromagnet is placed to face said hinged iron flake in parallel.

19. The multifunctional constant temperature refrigerator with thermal carriers of claim 2, wherein said passage switching device comprises a roller which has a channel therein extending upwards in a direction of the diameter, a reset gravity bar is disposed at the inner surface of the roller, a hinged iron flake is disposed below the roller, an electromagnet is mounted at the inner surface of the air flow duct which is adjacent the inlet of the dual flow passage with respect to said hinged iron flake, and said electromagnet is placed to face said hinged iron flake in parallel.

20. The multifunctional constant temperature refrigerator with thermal carriers of claim 3, wherein said passage switching device comprises a roller which has a channel therein extending upwards in a direction of the diameter, a reset gravity bar is disposed at the inner surface of the roller, a hinged iron flake is disposed below the roller, an electromagnet is mounted at the inner surface of the air flow duct which is adjacent the inlet of the dual flow passage with respect to said hinged iron flake, and said electromagnet is placed to face said hinged iron flake in parallel.

* * * * *